US008991415B1

(12) United States Patent
Luppino

(10) Patent No.: US 8,991,415 B1
(45) Date of Patent: Mar. 31, 2015

(54) FIRE HYDRANT BREAK OFF VALVE

(71) Applicant: Francesco Luppino, Huntington Park, CA (US)

(72) Inventor: Francesco Luppino, Huntington Park, CA (US)

( * ) Notice: Subject to any disclaimer, the term of this patent is extended or adjusted under 35 U.S.C. 154(b) by 0 days.

(21) Appl. No.: 14/303,808

(22) Filed: Jun. 13, 2014

Related U.S. Application Data

(60) Provisional application No. 61/896,067, filed on Dec. 19, 2013.

(51) Int. Cl.
*F16K 17/40* (2006.01)
*E03B 9/04* (2006.01)

(52) U.S. Cl.
CPC ..... *E03B 9/04* (2013.01)
USPC .... 137/68.14; 137/68.11; 137/67; 137/68.16; 137/272; 137/280; 137/286; 137/290; 137/520; 137/523; 251/298; 251/305; 251/66

(58) Field of Classification Search
CPC ..... F16K 17/406; F16K 13/06; F16K 31/001; E03B 9/02; E03B 2009/022
USPC ..... 137/67, 68.11, 68.14, 68.15, 68.16, 70, 137/272, 280, 285, 286, 300, 290, 520, 137/523; 251/298, 305, 66
See application file for complete search history.

(56) References Cited

U.S. PATENT DOCUMENTS 982,400 A * 1/1911 Walker ..... 137/514.5
2,054,561 A * 9/1936 Greenberg ..... 137/68.14
2,171,078 A * 8/1939 Cline ..... 285/4
2,340,965 A * 2/1944 Kiesel ..... 403/2
3,013,579 A * 12/1961 Gilliam ..... 137/515.5
3,065,950 A * 11/1962 Goldberg ..... 251/160
3,860,025 A * 1/1975 Nelson ..... 137/68.14
4,119,111 A * 10/1978 Allread ..... 137/68.14
4,127,142 A * 11/1978 Snider ..... 137/68.15
4,361,165 A * 11/1982 Flory ..... 137/69
4,596,263 A 6/1986 Snider
4,625,746 A * 12/1986 Calvin et al. ..... 137/68.15
4,667,883 A * 5/1987 Fink, Jr. ..... 239/569
4,770,393 A * 9/1988 Hubertson ..... 251/306
4,852,602 A * 8/1989 McKinnon ..... 137/68.14
5,158,265 A * 10/1992 Miyairi ..... 251/305
5,193,569 A * 3/1993 Moore et al. ..... 137/71
5,305,776 A * 4/1994 Romano ..... 137/68.14
5,609,179 A * 3/1997 Knapp ..... 137/68.16
5,699,823 A * 12/1997 Thomson ..... 137/68.15
5,765,587 A * 6/1998 Osborne ..... 137/68.14
5,941,268 A * 8/1999 Ross, Jr. ..... 137/68.14
6,178,982 B1 * 1/2001 Longstreth ..... 137/68.14
6,401,745 B1 6/2002 Corder
7,156,119 B2 1/2007 Freudendahl
7,267,136 B2 9/2007 Fleury, Jr. et al.
8,336,570 B2 * 12/2012 Cardona ..... 137/68.14

(Continued)

*Primary Examiner* — John K Fristoe, Jr.
*Assistant Examiner* — Minh Le
(74) *Attorney, Agent, or Firm* — Kenneth L. Green

(57) ABSTRACT

A fire hydrant break off valve includes an offset pivot and a lateral trigger captured between a fire hydrant and fire hydrant break off riser. When a collision breaks the break off bolts holding the fire hydrant to the hydrant break off riser, the lateral trigger is released and the valve rotates to a closed position. Force of water attempting to escape rotates the valve around the offset pivot. The edge of the valve is tapered and after rotating, the valve is pushed against a matching seat to close the valve. The match of the tapered valve against the tapered seat stops or nearly stops all flow of water from the broken hydrant.

12 Claims, 6 Drawing Sheets

(56) References Cited

U.S. PATENT DOCUMENTS 8,528,836 B2 * 9/2013 Boyajian ..... 239/204
2003/0150486 A1 * 8/2003 Liebert ..... 137/68.14
2005/0224114 A1 * 10/2005 Cook et al. ..... 137/68.14
2013/0248748 A1 * 9/2013 Baumann ..... 251/305

* cited by examiner

FIRE HYDRANT BREAK OFF VALVE

BACKGROUND OF THE INVENTION

The present invention relates to fire hydrants and in particular to preventing a loss of water when a fire hydrant breaks off.

Most cities have fire hydrants spaced between 200 and 500 feet apart and next to a street. Such spacing results in a very large number of fire hydrants and proximity to a street results in periodic collisions causing the fire hydrant to break off from its respective water source. The fire hydrants are specifically mounted using break off bolts which includes a narrow belt to result in the fire hydrant breaking off from a break off riser before the break off riser is damaged.

Various break off valves have been designed and used to prevent or minimize the loss water when the fire hydrant breaks off from the break off riser, but known break off valves have either failed to operate as intended, or allowed substantial water to escape even when they work as intended.

BRIEF SUMMARY OF THE INVENTION

The present invention addresses the above and other needs by providing a fire hydrant break off valve which includes an offset pivot and a lateral trigger captured between a fire hydrant and fire hydrant break off riser. When a collision breaks the break off bolts holding the fire hydrant to the hydrant break off riser, the lateral trigger is released and the valve rotates to a closed position. The force of water attempting to escape rotates the valve around the offset pivot. The edge of the valve is frustoconically tapered, and after rotating, the valve is pushed against a matching seat to close the valve. The match of the tapered valve against the tapered seat stops or nearly stops all flow of water escaping from the broken hydrant.

In accordance with one aspect of the invention, there is provided a fire hydrant break off valve having an offset pivot. The offset pivot results in the valve pivoting nearly instantly to a closed position when the hydrant breaks away from the fire hydrant break off riser.

In accordance with another aspect of the invention, there is provided a fire hydrant break off valve having a tapered edge. The taper faces upward and meets a matching riser taper to nearly instantly stop the flow of water. The geometry of the valve's offset pivot and the tapered edges allows the edge of the valves nearest the pivot to pivot past a respective riser taper and then seal against the riser taper.

In accordance with still another aspect of the invention, there is provided a fire hydrant break off valve having a diagonal trigger. The trigger is pivotally attached to the valve at a valve end, and captured between the fire hydrant and fire hydrant break off riser, holding the valve open during normal conditions. When the fire hydrant breaks away, the trigger is released allowing water pressure to close the valve.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
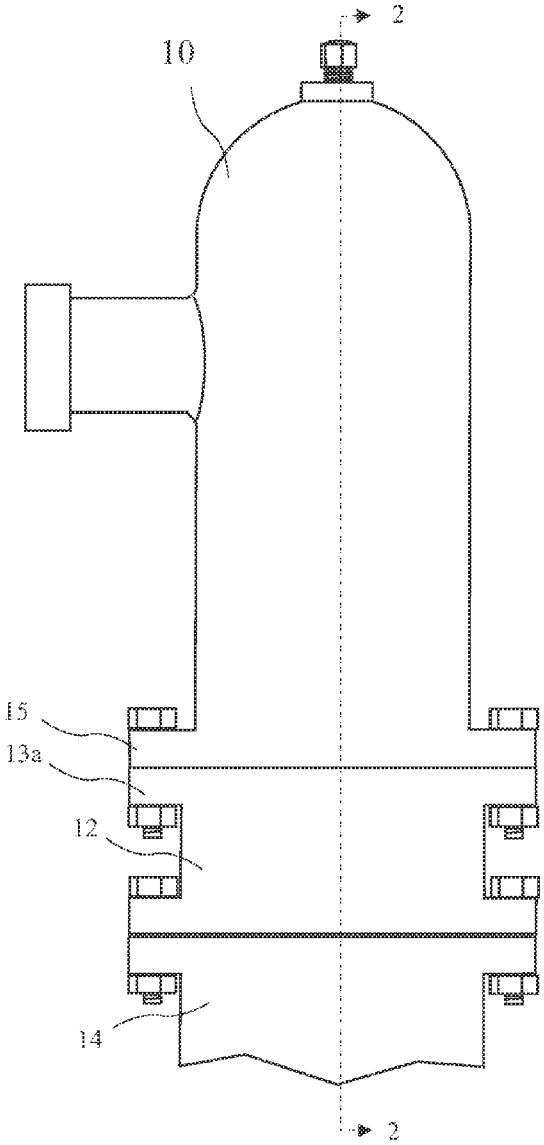
FIG. 1 is a side view of a fire hydrant and fire hydrant break off riser according to the present invention.
Figure 2:
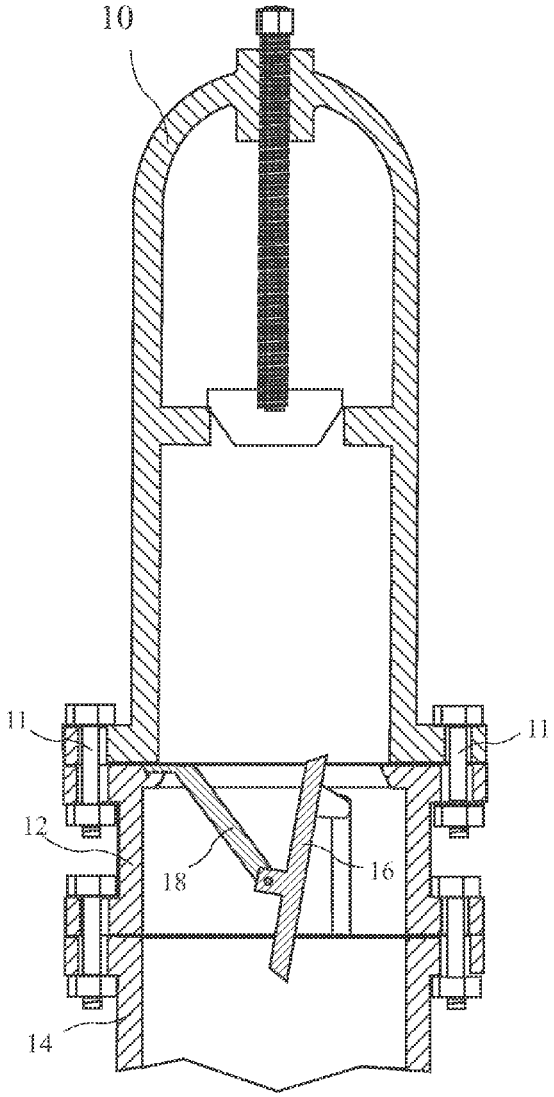
FIG. 2 is a cross-sectional view of the fire hydrant and the fire hydrant break off riser according to the present invention taken along line 2-2 of FIG. 1.

A side view of a fire hydrant 10 and fire hydrant break off riser 12 according to the present invention is shown in FIG. 1 and a cross-sectional view of the fire hydrant and the fire hydrant break off riser taken along line 2-2 of FIG. 1. is shown in FIG. 2. The fire hydrant 10 is attached to the fire hydrant break off riser 12 by break off bolts 11 through hydrant flanged 15 and top riser flanges 13*a*. In the event that a vehicle collides with the fire hydrant 10, the break off bolts 11 break before the fire hydrant break off riser 12 is damaged. The fire hydrant break off riser 12 is further connected to a water main 14.

The fire hydrant break off riser 12 includes a valve 16 having a pivot axle 20 and held open by a diagonal trigger 18. A first end of the diagonal trigger 18 is pivotally attached to the valve 16 and a second end of the diagonal pivot 18 is captured between the fire hydrant 10 and fire hydrant break off riser 12 to hold the valve 16 open during normal operation.

Figure 3A:
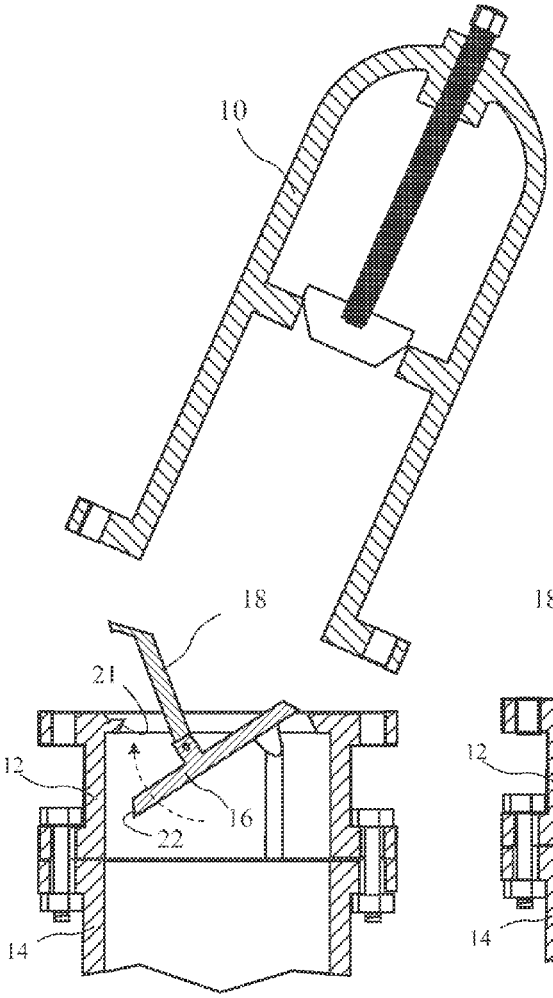
FIGS. 3A and 3B show the fire hydrant and the fire hydrant break off riser according to the present invention with the fire hydrant breaking away from the fire hydrant break off riser.
Figure 3B:
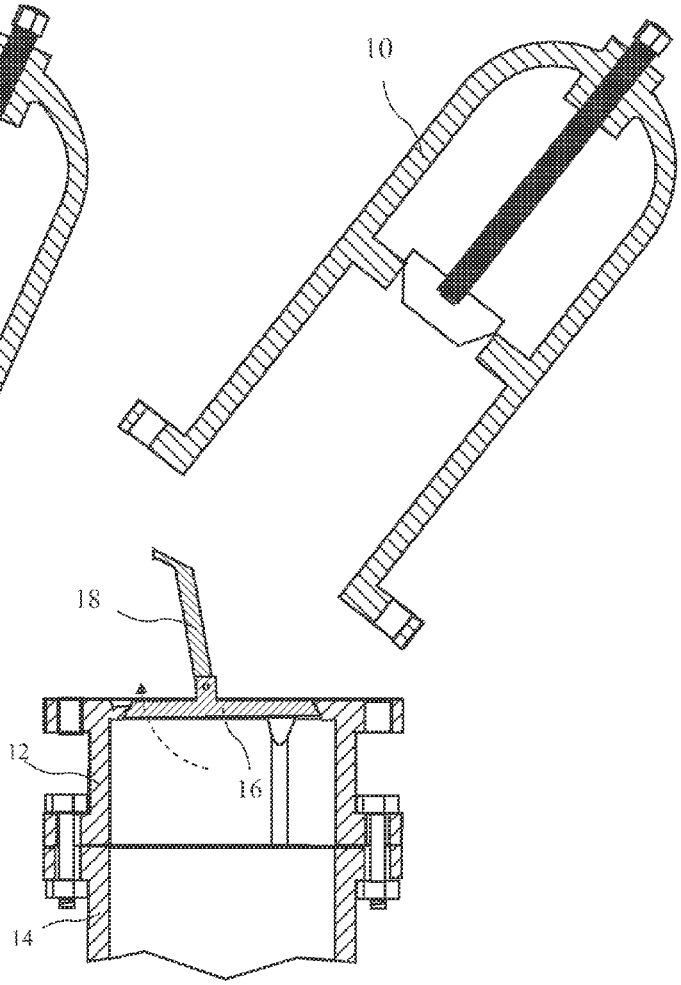

The fire hydrant 10 and the fire hydrant break off riser 12 with the fire hydrant 10 breaking away from the fire hydrant break off riser 12 is shown in FIGS. 3A and 3B. As soon as the fire hydrant 10 breaks away from the fire hydrant break off riser 12 the diagonal trigger 18 is released and the valve 16 begins to pivot to a closed position. The water below the fire hydrant break off riser 12 then pushes the valve 16 to complete pivoting and forces an upward facing valve tapered edge 22 against a downward facing tapered seat 21.

Figure 4C:
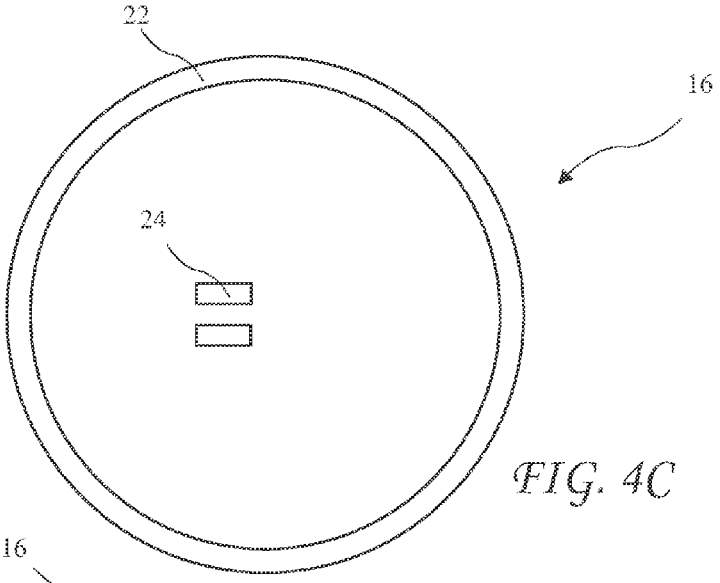
FIG. 4C shows a top view of the valve of the fire hydrant break off riser according to the present invention.
Figure 4A:
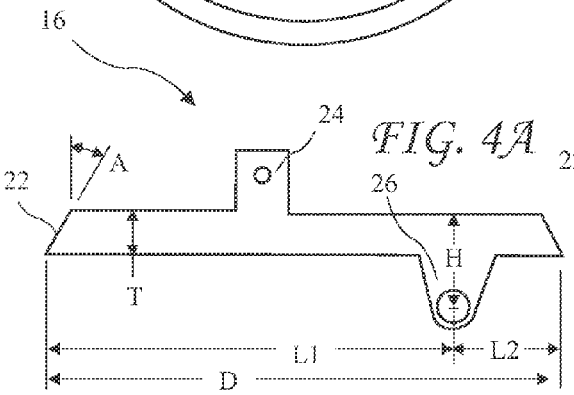
FIG. 4A shows a side view of a valve of the fire hydrant break off riser according to the present invention.
Figure 4B:
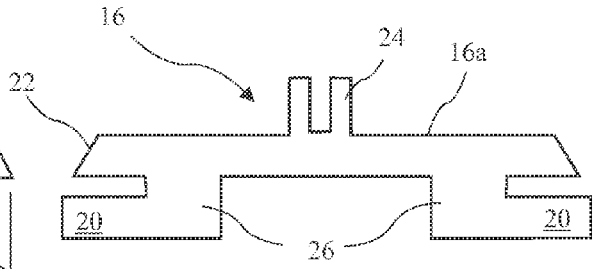
FIG. 4B shows a front view of the valve of the fire hydrant break off riser according to the present invention.
Figure 4D:
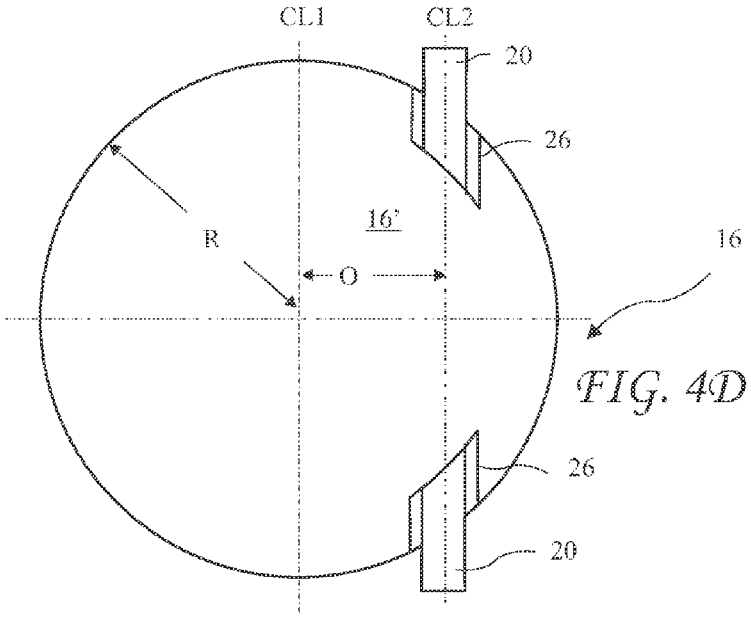
FIG. 4D shows a bottom view of the valve of the fire hydrant break off riser according to the present invention.

A side view of the valve 16 is shown in FIG. 4A, a front view of the valve 16 is shown in FIG. 4B, a top view of the valve 16 is shown in FIG. 4C, and a bottom view of the valve 16 is shown in FIG. 4D. The valve 16 includes the upward facing circumferential valve tapered edge 22, diagonal trigger bosses 24 on a top surface 16*a* of the valve 16 for pivotally attaching the diagonal trigger 18 to the valve 16, and offset axle bosses 26 supporting axles 20 on an axle side 16' of the valve 16 for pivotally attaching the valve 16 to the fire hydrant break off riser 12.

The axle bosses 26 center the pivot axle centerline CL2 a longer length L1 from a far side of the valve 16, and a shorter distance L2 from a near side of the valve 16. The valve has a diameter D of L1 plus L2 and the pivot axle centerline CL2 is offset from the valve centerline CL1 an offset O. The valve tapered edge 22 has a taper angle A, and the valve 16 has the thickness T, and the pivot axle 20 is a height H below a top surface of the valve 16. The diameter D is preferably about 6.326 inches, the offset O is preferably about 1.75 inches, the length L1 is preferably about 4.913 inches, the length L2 is preferably about 1.413 inches, the angle A is preferably about 30 degrees, the thickness T is preferably about 0.5 inches, and the height H is preferably about 1.00 inches. Preferably, the offset O is about 57 percent of a radius R of the valve 16 of the valve 16.

Figure 5D:
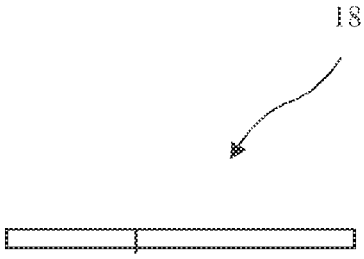
FIG. 5D is a top view of the diagonal trigger of the fire hydrant break off riser according to the present invention.
Figure 5B:
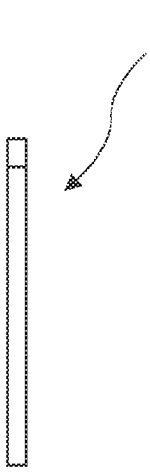
FIG. 5B is a front view of the diagonal trigger of the fire hydrant break off riser according to the present invention.
Figure 5A:
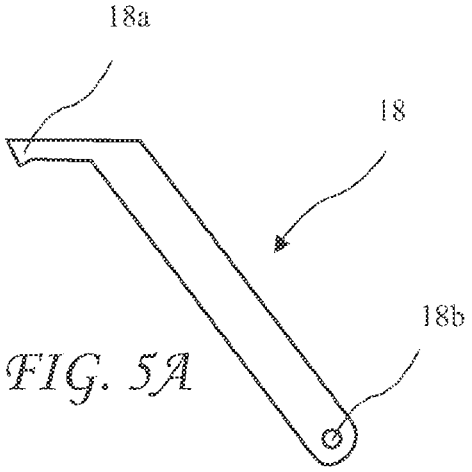
FIG. 5A is a side view of a diagonal trigger of the fire hydrant break off riser according to the present invention.
Figure 5C:
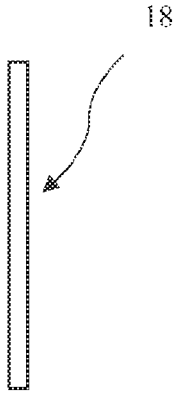
FIG. 5C is a rear view of the diagonal trigger of the fire hydrant break off riser according to the present invention.
Figure 5E:
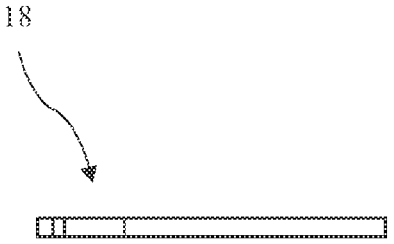
FIG. 5E is a bottom view of the diagonal trigger of the fire hydrant break off riser according to the present invention.

A side view of the diagonal trigger is shown in FIG. 5A, a front view of the diagonal trigger is shown in FIG. 5B, a rear view of the diagonal trigger is shown in FIG. 5C, a top view of the diagonal trigger is shown in FIG. 5D, and a bottom view of the diagonal trigger is shown in FIG. 5E. The diagonal trigger 18 preferably includes a hooked second end 18*a* for securely capturing the second end between the fire hydrant 10 and the fire hydrant break off riser 12. A passage 18*b* is provided in the first end for pivotally attaching the diagonal trigger to the valve 16.

Figure 6:
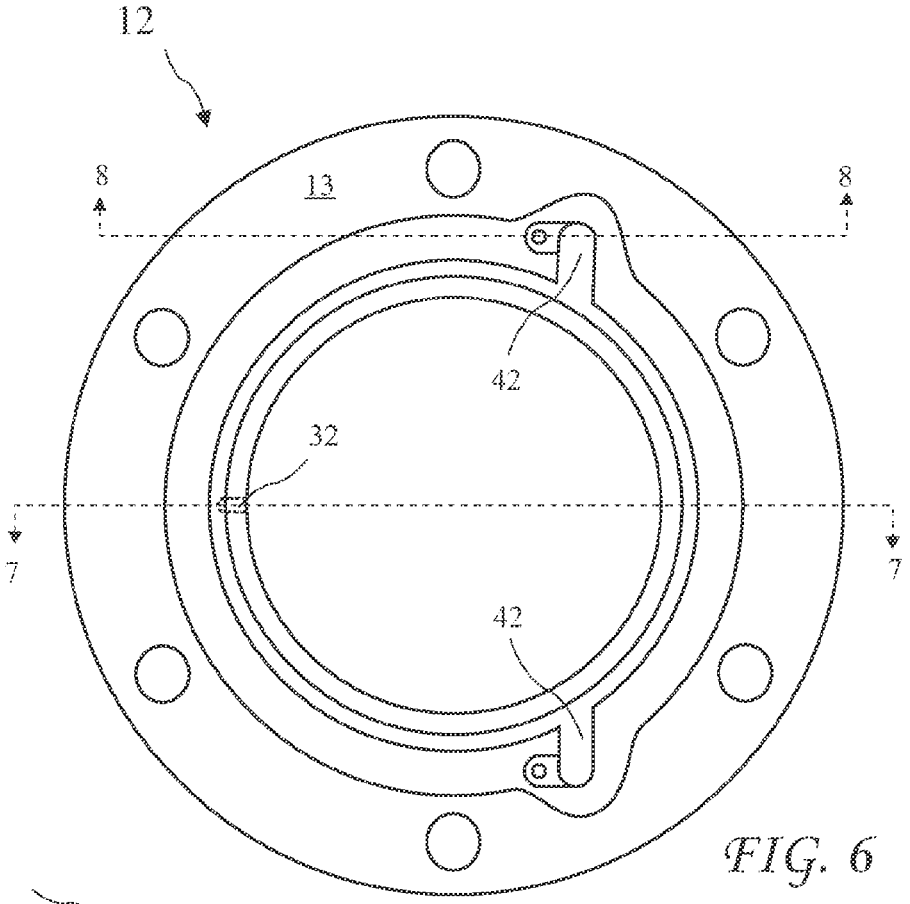
FIG. 6 is a bottom view of the fire hydrant break off riser according to the present invention.

A bottom view of the fire hydrant break off riser 12 is shown in FIG. 6. The fire hydrant break off riser 12 includes valve keeper slots 42 which receive valve keepers 40 to retain the valve pivot axle 20 (see FIG. 2). A trigger pocket 32 is provided in a top surface of the riser body 13 for receiving the hooked second end 18*a* of the diagonal trigger 18 during normal operation.

Figure 7:
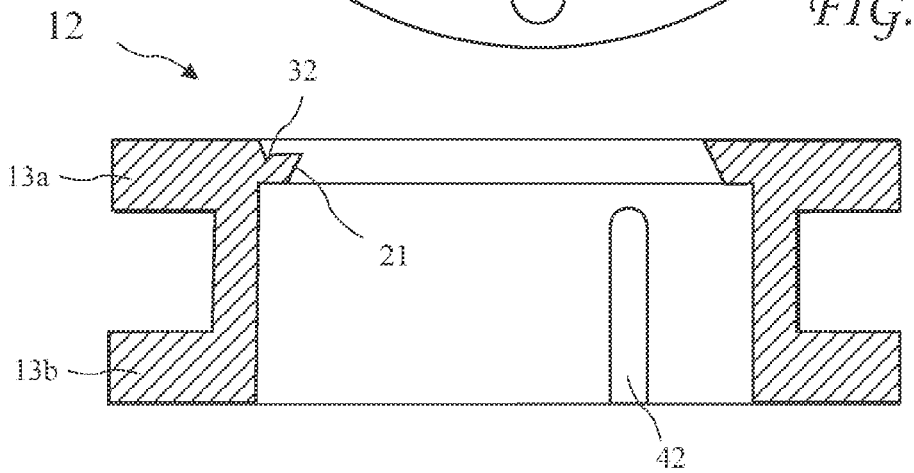
FIG. 7 is a cross-sectional view of the fire hydrant break off riser according to the present invention taken along line 7-7 of FIG. 6.
Figure 8:
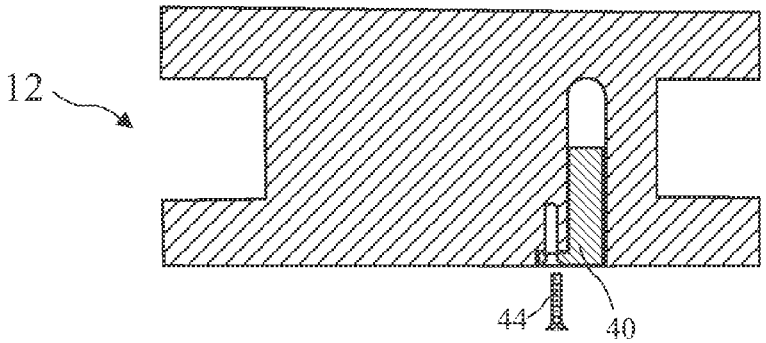
FIG. 8 is a cross-sectional view of the fire hydrant break off riser according to the present invention taken along line 8-8 of FIG. 6.
Figure 9:
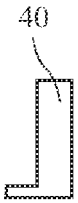
FIG. 9 is a valve keeper of the fire hydrant break off riser according to the present invention.

A cross-sectional view of the fire hydrant break off riser 12 taken along line 7-7 of FIG. 6 is shown in FIG. 7 and a cross-sectional view of the fire hydrant break off riser 12 taken along line 8-8 of FIG. 6 is shown in FIG. 8, and the valve keeper 40 is shown in FIG. 9. The fire hydrant break off riser 12 includes a riser body 13 having a top flange 13*a* for attachment to the fire hydrant 10, and a bottom flange for attachment to the water main 14. The valve keeper slot 42 allows the valve keeper 40, valve 12 and valve pivot axle 20 to be installed and removed from the fire hydrant break off riser 12, and holds the valve 16 in place in the fire hydrant break off riser 12. A screw 44 holds the valve keeper 40 in the valve keeper slot 42.

Figure 10:
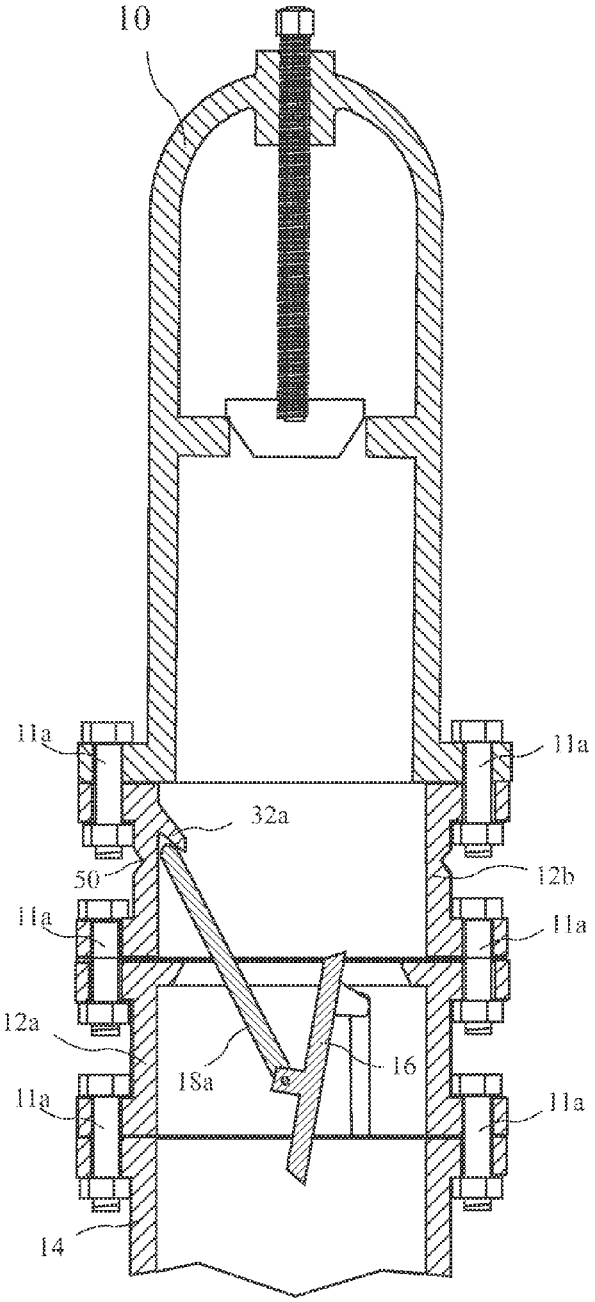
FIG. 10 shows a second embodiment of a two section fire hydrant break off riser according to the present invention.
Figure 11:
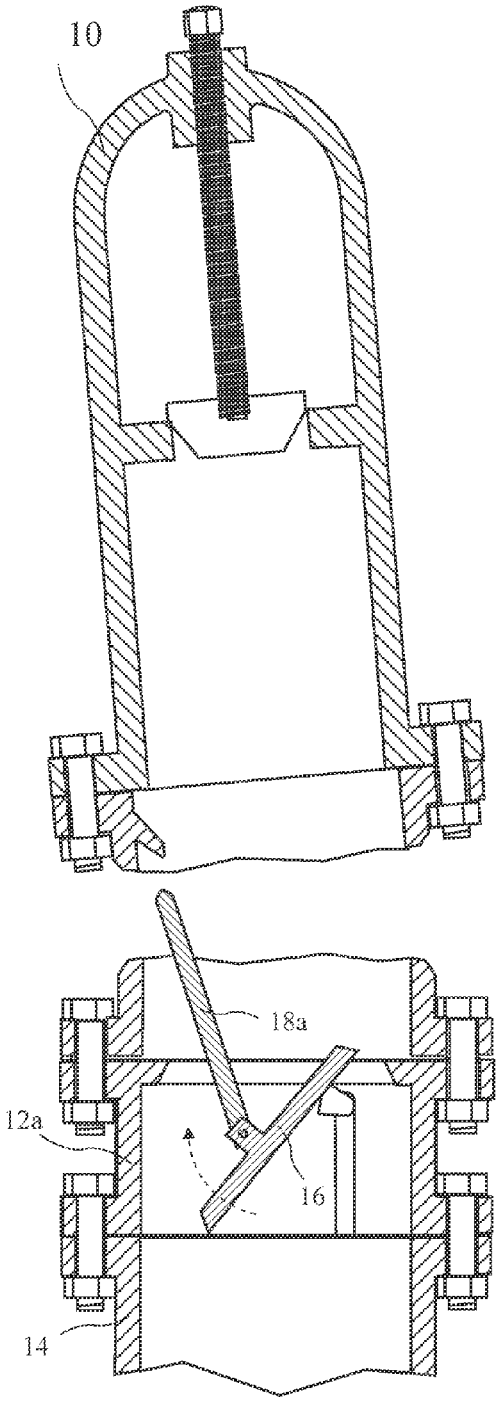
FIG. 11 shows the second embodiment after breaking away.

A second embodiment of a two section fire hydrant break off riser 12*a* and 12*b* is shown in FIG. 10 and the fire hydrant break off riser 12*a* and 12*b* after breaking away is shown in FIG. 11. The bottom riser 12*a* is very similar to the riser 12, but without the trigger pocket 32. The top section 12*b* includes a second pocket 32*a* and an end of the second diagonal trigger 18*a* resided in the pocket 52 during normal operation. The riser 12*b* also includes a circumferential notch 50 creating a weak ring around the riser 12*b*. The break off bolts 11 of the first embodiment are replaced with full strength bolts 11*a*, and upon a sufficient impact, the riser 12*b* separates at the notch 50, the diagonal trigger 18*a* is released from the pocket 52, and the valve 16 is free to pivot to a closed position.

While the invention herein disclosed has been described by means of specific embodiments and applications thereof, numerous modifications and variations could be made thereto by those skilled in the art without departing from the scope of the invention set forth in the claims.

I claim:

1. A fire hydrant break off riser, comprising:

a riser body comprising:

a top flange for attachment to a fire hydrant;

a bottom flange for seating against a water main;

a downward facing tapered seat;

pivot axle seats; and at least a portion of a trigger pocket;

a valve including an upward facing circumferential valve seat adapted to seat against the tapered seat in the riser body;

at least one pivot axle pivotally connecting the valve to the riser body, the at least one pivot axle residing laterally offset on an axle side of the valve between a center of the valve and an edge of the valve;

at least part of the trigger pocket is formed by a break away portion; and a diagonal trigger residing in the trigger pocket at a second end, and pivotally attached to the valve at a first end, the first end opposite to the second end, wherein;

the valve is held in an open position by the diagonal trigger while the second end of the diagonal trigger is restrained by the trigger pocket during normal operation; and when the break away portion breaks away, the diagonal trigger is released from the trigger pocket, the valve pivots to a closed position, and the upward facing valve seat is forced against the downward facing tapered seat by water pressure.

2. The fire hydrant break off riser of claim 1, wherein pivot axle bosses reside on a bottom surface of the valve and carry the pivot axles.

3. The fire hydrant break off riser of claim 2, wherein:

The valve has a diameter D of about 6.326 inches; and a centerline CL2 of the pivot axles is offset laterally approximately 1.75 inches from the centerline CL1 of the cover.

4. The fire hydrant break off riser of claim 3, wherein the centerline CL2 of the pivot axles is approximately one inch below a top surface of the valve.

5. The fire hydrant break off riser of claim 2, wherein the pivot axles are inserted into the riser body through valve keeper slots extending to the bottom of the riser body and held in place by valve keepers residing under the pivot axles.

6. The fire hydrant break off riser of claim 1, wherein:

the break away portion comprises the fire hydrant only;

the riser body is a single riser body residing between a water main and a fire hydrant;

the fire hydrant is attached to the riser body by break away bolts; and the trigger pocket is formed between a top flange of the riser body and a hydrant flange.

7. The fire hydrant break off riser of claim 1, wherein:
the break away portion comprises the fire hydrant and part of a top riser body;
the riser body comprises:
a bottom riser body comprising:
a first top flange;
a first bottom flange for seating against the water main;
a downward facing tapered seat just below the first top flange; and
pivot axle seats;
the top riser body comprising:
a second top flange for seating against the fire hydrant;
a second bottom flange for seating against the first top flange of the bottom riser body;
a trigger pocket in an inside wall; and
a circumferential notch creating a weak ring around the top riser body;
the top riser body is attached to the fire hydrant by high strength bolts;
the top riser body is attached to the bottom riser body by the high strength bolts; and
the bottom riser body is attached to the water main by the high strength bolts.

8. A fire hydrant break off riser, comprising:
a riser body comprising:
a top flange for attachment to a fire hydrant;
a bottom flange for seating against a water main;
a downward facing tapered seat;
pivot axle seats; and
a trigger pocket formed between the top flange of the riser body and a hydrant flange of the fire hydrant;
break away bolts attaching the fire hydrant to the riser body;
a valve including an upward facing circumferential valve seat adapted to seat against the tapered seat in the riser body;
at least one pivot axle pivot axle carried on bosses residing on a bottom surface of the valve, the at least one pivot axle pivotally connecting the valve to the riser body, the at least one pivot axle residing horizontally offset on an axle side of the valve about 57% of a radius R of the valve, and a height H of about one inch below a top surface of the valve;
and
a diagonal trigger residing in the trigger pocket at a second end, and pivotally attached to the valve at a first end, the first end opposite to the second end,
wherein:
the valve is held in an open position by the diagonal trigger while the second end of the diagonal trigger is restrained by the trigger pocket during normal operation; and
when the fire hydrant breaks away from the riser body, the diagonal trigger is released from the trigger pocket, the valve pivots to a closed position, and the upward facing valve seat is forced against the downward facing tapered seat by water pressure.

9. A fire hydrant break off riser, comprising:
a two piece riser body comprising:
a bottom riser body comprising:
a first top flange;
a first bottom flange for seating against the water main;
a downward facing tapered seat just below the first top flange; and
pivot axle seats;
a top riser body comprising:
a second top flange for seating against the fire hydrant;
a second bottom flange for seating against the first top flange of the bottom riser body;
a circumferential notch between the second bottom flange and the second top flange creating a weak ring around the top riser body;
a trigger pocket in an inside wall of the top riser body, above the circumferential notch; and
a break way portion of the top riser body above the circumferential notch;
the bottom riser body is attached to the fire hydrant by high strength bolts;
the top riser body is attached to the bottom riser body by the high strength bolts; and
the top riser body is attached to the fire hydrant by the high strength bolts;
a valve including an upward facing circumferential valve seat adapted to seat against the tapered seat in the bottom riser body;
at least one pivot axle carried on bosses residing on a bottom surface of the valve, the pivot axles pivotally connecting the valve to the bottom riser body, the at least one pivot axle residing horizontally offset on an axle side of the valve about 57% of a radius R of the valve, and a height H of about one inch below a top surface of the valve;
and
a diagonal trigger residing in the trigger pocket at a second end, and pivotally attached to the valve at a first end, the first end opposite to the second end,
wherein the valve is held in an open position by the diagonal trigger while the second end of the diagonal trigger is restrained by the trigger pocket during normal operation, and the valve pivots to a closed position when the diagonal trigger is released from the trigger pocket when the top riser body breaks at the circumferential notch and the break away portion breaks away, and the upward facing valve seat is forced against the downward facing tapered seat by water pressure.

10. The fire hydrant break off riser of claim 1, wherein the pivot axle resides below the valve seat.

11. The fire hydrant break off riser of claim 1, wherein the pivot axle resides between a center of the valve and an edge of the valve seat.

12. The fire hydrant break off riser of claim 1, wherein the at least one pivot axle residing horizontally offset on an axle side of the valve about 57% of a radius R of the valve, and a height H of about one inch below a top surface of the valve.

* * * * *